US009845435B2

(12) United States Patent
Niitsuma et al.

(10) Patent No.: US 9,845,435 B2
(45) Date of Patent: Dec. 19, 2017

(54) DIESEL FUEL OR DIESEL FUEL BASE STOCK AND PRODUCTION METHOD THEREOF

(71) Applicants: Japan Oil, Gas and Metals National Corporation, Tokyo (JP); Inpex Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel & Sumikin Engineering Co., Ltd., Tokyo (JP)

(72) Inventors: Takuya Niitsuma, Tokyo (JP); Marie Iwama, Tokyo (JP)

(73) Assignees: Japan Oil, Gas and Metals National Corporation, Tokyo (JP); INPEX CORPORATION, Tokyo (JP); JX Nippon Oil & Energy Corporation, Tokyo (JP); Japan Petroleum Exploration Co., Ltd., Tokyo (JP); COSMO OIL CO., LTD., Tokyo (JP); NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 262 days.

(21) Appl. No.: 14/387,608

(22) PCT Filed: Mar. 27, 2013

(86) PCT No.: PCT/JP2013/058966
§ 371 (c)(1),
(2) Date: Sep. 24, 2014

(87) PCT Pub. No.: WO2013/146867
PCT Pub. Date: Oct. 3, 2013

(65) Prior Publication Data
US 2015/0065761 A1 Mar. 5, 2015

(30) Foreign Application Priority Data
Mar. 28, 2012 (JP) ..... 2012-075017

(51) Int. Cl.
*C10G 67/00* (2006.01)
*C10L 1/06* (2006.01)
(Continued)

(52) U.S. Cl.
CPC ..... *C10G 67/00* (2013.01); *C10G 2/30* (2013.01); *C10G 45/58* (2013.01); *C10G 47/00* (2013.01);
(Continued)

(58) Field of Classification Search
CPC . C10G 67/00; C10L 1/06; C10L 10/14; C10L 10/16
See application file for complete search history.

(56) References Cited

U.S. PATENT DOCUMENTS

2008/0194901 A1 8/2008 Cramwinckel et al.
2009/0126264 A1 5/2009 Hirose et al.
(Continued)

FOREIGN PATENT DOCUMENTS

EP 2199372 A1 6/2010
EP 2199373 A1 6/2010
(Continued)

OTHER PUBLICATIONS

Extended Search Report dated Oct. 14, 2015 in EP Application No. 13767673.0.
(Continued)

*Primary Examiner* — In Suk Bullock
*Assistant Examiner* — Youngsul Jeong
(74) *Attorney, Agent, or Firm* — Panitch Schwarze Belisario & Nadel LLP

(57) ABSTRACT

Provided is a hydrotreating step (A) containing a hydroisomerization step (A1) that obtains a hydroisomerized oil (a1) by bringing a FT synthesis oil into contact with a hydroisomerization catalyst and/or a hydrocracking step (A2) that obtains a hydrocracked oil (a2) by bringing it into contact with a hydrocracking catalyst, and a fractionation step (B) that transfers at least a portion of the hydrotreated oil (a) composed of the hydroisomerized oil (a1) and/or the hydrocracked oil (a2) to a fractionator and, at the very least, obtains a middle distillate (b1) with a 5% distillation point of 130 to 170° C. and a 95% distillation point of 240 to 300° C., and a heavy oil (b2) that is heavier than the middle distillate (b1).

10 Claims, 1 Drawing Sheet

(51) Int. Cl.

| | |
|---|---|
| ***C10L 10/16*** | (2006.01) |
| ***C10L 10/14*** | (2006.01) |
| ***C10G 65/14*** | (2006.01) |
| ***C10L 1/08*** | (2006.01) |
| ***C10G 45/58*** | (2006.01) |
| ***C10G 47/00*** | (2006.01) |
| ***C10G 2/00*** | (2006.01) |

(52) U.S. Cl.

CPC ..... *C10G 65/14* (2013.01); *C10L 1/06* (2013.01); *C10L 1/08* (2013.01); *C10L 10/14* (2013.01); *C10L 10/16* (2013.01); *C10G 2300/1022* (2013.01); *C10G 2300/4081* (2013.01); *C10L 2200/0492* (2013.01); *C10L 2270/026* (2013.01); *C10L 2290/10* (2013.01)

(56) References Cited

U.S. PATENT DOCUMENTS

| | | | | |
|---|---|---|---|---|
| 2010/0294696 | A1 | 11/2010 | Tanaka et al. | |
| 2010/0300933 | A1* | 12/2010 | Tanaka ..... | C10G 45/58 208/62 |
| 2011/0113676 | A1 | 5/2011 | Mackay et al. | |

FOREIGN PATENT DOCUMENTS

| | | | |
|---|---|---|---|
| EP | 2551330 | A1 | 1/2013 |
| JP | 2004-323626 | A | 11/2004 |
| JP | 2007-269901 | A | 10/2007 |
| JP | 2009-221298 | A | 10/2009 |
| JP | 2011-173987 | A | 9/2011 |
| JP | 2011-208004 | A | 10/2011 |
| WO | 2009041478 | A1 | 4/2009 |
| WO | 2009041487 | A1 | 4/2009 |

OTHER PUBLICATIONS

Office Action dated Nov. 30, 2015 in EA Application No. 201491627.

"Cetane Number," Bolshaya Sovietskaya Entsiklopediya.

GOST R 52368-2005, "National Standard of the Russian Federation".

GOST 32463-2013, "National Standard of the Russian Federation".

Office Action dated Jun. 28, 2016 in EA Application No. 201491627.

Int'l Search Report dated Jun. 18, 2013 in Int'l Application No. PCT/JP2013/058966.

* cited by examiner

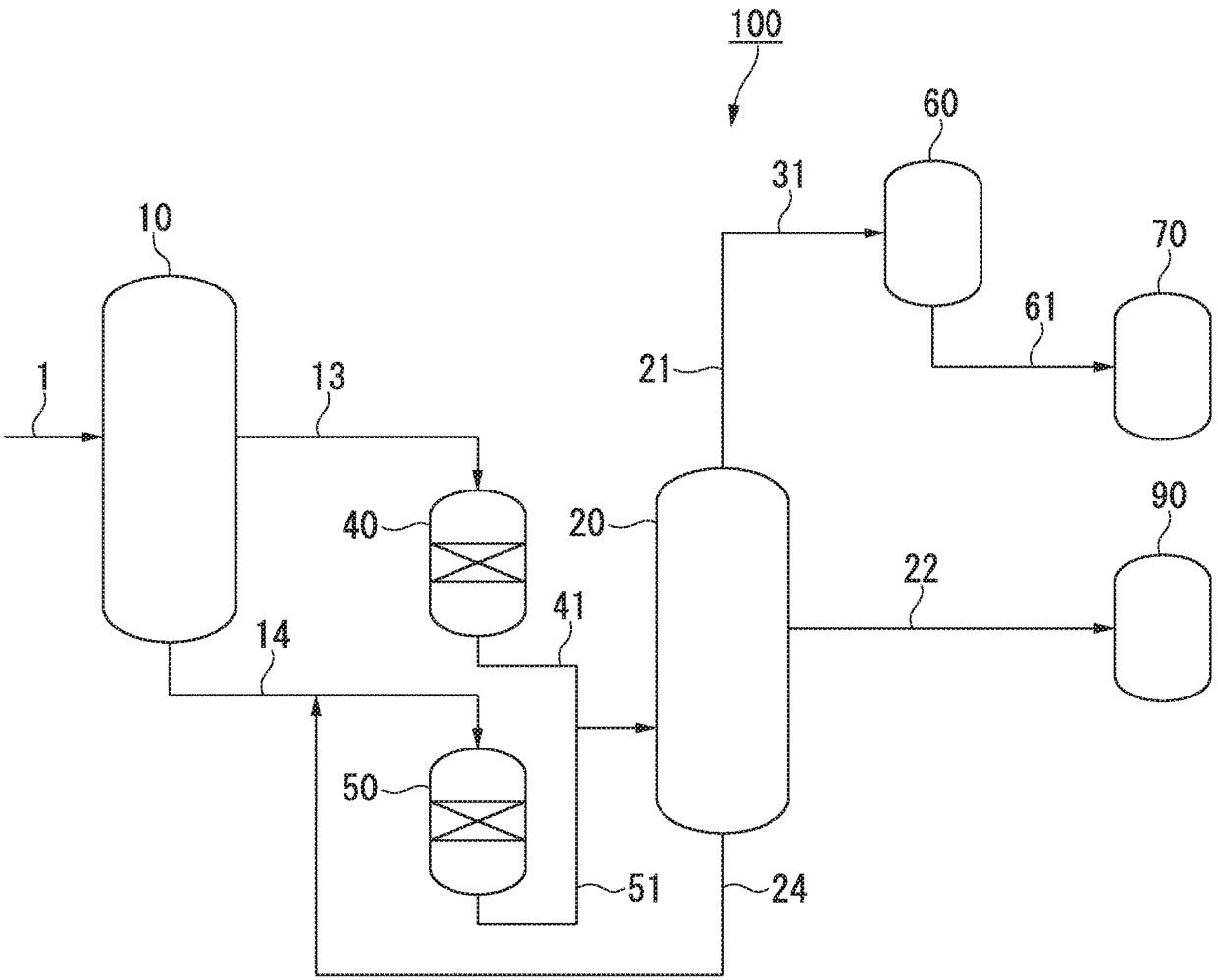
100
1
10
13
14
40
50
41
51
20
21
24
31
60
61
70
22
90

DIESEL FUEL OR DIESEL FUEL BASE STOCK AND PRODUCTION METHOD THEREOF

CROSS-REFERENCE TO RELATED APPLICATION

This application is a Section 371 of International Application No. PCT/JP2013/058966, filed Mar. 27, 2013, which was published in the Japanese language on Oct. 3, 2013, under International Publication No. WO 2013/146867 A1, and the disclosure of which is incorporated herein by reference.

TECHNICAL FIELD

The present invention relates to a diesel fuel or a diesel fuel base stock and a production method thereof.

Priority is claimed on Japanese Patent Application No. 2012-075017, filed Mar. 28, 2012, the content of which is incorporated herein by reference.

BACKGROUND ART

In recent years, from the viewpoint of environmental load reduction, there has been a need for environmentally friendly and clean liquid fuels with a low sulfur content and aromatic hydrocarbon content. Therefore, in the oil industry, as a production method of clean fuels, the Fischer-Tropsch synthesis method (hereunder also referred to as "FT synthesis method") using carbon monoxide and hydrogen as feedstocks is being investigated. The FT synthesis method has very high expectations since it can manufacture a liquid fuel base stock rich in paraffin content and not containing a sulfur content, such as a diesel fuel base stock. For example, environmentally friendly fuel oils are also proposed in Patent Document 1.

Synthesis oils obtained by the FT synthesis method (hereunder also referred to as "FT synthesis oil") have a large n-paraffin component, and even if a diesel fuel base stock is obtained by fractionally distilling this FT synthesis oil, there is a concern that as is, the low-temperature performance of the diesel fuel base stock is insufficient.

Furthermore, a substantial amount of a wax fraction, which is a heavier component than the diesel fuel base stock, is simultaneously produced along with the diesel fuel base stock. Therefore, if a middle distillate which is lighter than the wax fraction can be produced by hydrocracking the wax fraction, it will lead to increased production of the diesel fuel base stock.

Therefore, a production method for a diesel fuel base stock that, in addition to producing a diesel fuel base stock by mixing a hydroisomerized first middle distillate and a middle distillate corresponding portion (cracked wax fraction) which is lighter than the wax fraction produced by hydrocracking the wax fraction, selectively decreases the n-paraffins in the heavy portion of the diesel fuel base stock obtained at that time, is proposed (Patent Document 2). According to this production method, the low-temperature properties of the diesel fuel base stock itself can be improved.

PRIOR ART DOCUMENTS

Patent Documents

Patent Document 1: Japanese Unexamined Patent Application, First Publication No. 2004-323626.

Patent Document 2: PCT International Publication No. WO 09/041,487.

DISCLOSURE OF INVENTION

Problems to be Solved by the Invention

However, in the technology of Patent Document 2, only a diesel fuel base stock with a pour point of approximately −7.5 to −17.5° C. is obtained. Therefore, further improvements in the low-temperature properties are necessary for utilization in cold areas with lower temperatures. Furthermore, a kinematic viscosity (kinematic viscosity at 30° C. for example) of a certain value or higher is also required for reasons such as oil film break down at the time of operation. However, the pour point and the kinematic viscosity are in a trade-off relationship. Therefore, at the time the diesel fuel base stock is produced, even if it is produced such that the pour point is simply lowered, the kinematic viscosity becomes too low and becomes unacceptable as an obtained diesel fuel base stock.

Therefore, an object of the present invention is to provide a FT synthesis oil-derived diesel fuel or diesel fuel base stock having a pour point and a kinematic viscosity suitable for utilization under very low temperature environments, and a production method thereof. More specifically, to provide a diesel fuel or a diesel fuel base stock with a pour point of −45° C. or lower, and a kinematic viscosity at 30° C. of 1.3 $mm^2/s$ or more, and a production method thereof.

Means for Solving the Problem

As a result of keen investigation to solve the problem, the present inventor has arrived at completing the present invention by finding out that by adjusting the hydrotreating conditions and/or the fractionation conditions, a diesel fuel or a diesel fuel base stock with excellent low-temperature properties, in which the kinematic viscosity is a certain level or higher and the pour point is sufficiently low, can be produced from a FT synthesis oil.

That is, the production method for a diesel fuel or a diesel fuel base stock of the present invention is as follows.

(1) A production method for a diesel fuel or a diesel fuel base stock, including:

a hydrotreating step (A) containing a hydroisomerization step (A1) of obtaining a hydroisomerized oil (a1) by bringing a FT synthesis oil obtained by Fischer-Tropsch synthesis reaction, which contains a middle distillate and/or a wax fraction that is heavier than the middle distillate, into contact with a hydroisomerization catalyst, and/or a hydrocracking step (A2) of obtaining a hydrocracked oil (a2) by bringing it into contact with a hydrocracking catalyst; and a fractionation step (B) of transferring at least a portion of a hydrotreated oil (a) composed of the hydroisomerized oil (a1) and/or the hydrocracked oil (a2) to a fractionator and, at the very least, obtaining a middle distillate (b1) with a 5% distillation point of 130 to 170° C. and a 95% distillation point of 240 to 300° C., and a heavy oil (b2) that is heavier than the middle distillate (b1), wherein by adjusting the hydrotreating conditions in the hydrotreating step (A) and/or the fractionation conditions in the fractionation step (B), the middle distillate (b1), in which the flash point is 30 to 40° C., and the proportion of branched paraffins accounts for 60 mass % or more of the entire amount of paraffins, is obtained as a diesel fuel or a diesel fuel base stock.

(2) A production method for a diesel fuel or a diesel fuel base stock according to the item (1), wherein the hydrotreated oil (a) is a mixture between at least a portion of the hydroisomerized oil (a1) and at least a portion of the hydrocracked oil (a2).

(3) A production method for a diesel fuel or a diesel fuel base stock according to the items (1) or (2), wherein a hydrotreated feedstock for the hydroisomerization step (A1) is a FT synthesis middle distillate (F1) with a 10% distillation point of 85 to 180° C. and a 90% distillation point of 325 to 355° C., and a hydrotreated feedstock for the hydrocracking step (A2) is a wax fraction (F2) that is heavier than the FT synthesis middle distillate (F1).

(4) A production method for a diesel fuel or a diesel fuel base stock according to one of the items (1) to (3), wherein with respect to the hydroisomerized oil (a1), the proportion of branched paraffins with 18 carbon atoms accounts for 85 to 98 mass % of the hydrocarbons with 18 carbon atoms.

(5) A production method for a diesel fuel or a diesel fuel base stock according to one of the items (1) to (4) further including a recycling step (C) in which at least a portion of the heavy oil (b2) is mixed with the feedstock provided to the hydroisomerization step (A1) and/or the hydrocracking step (A2) and is hydrotreated again.

(6) A production method for a diesel fuel or a diesel fuel base stock according to the item (5), wherein with respect to the recycling step (C), at least a portion of the heavy oil (b2) is a fractionator bottom fraction containing hydrocarbons with 15 carbon atoms and higher, and the fractionator bottom fraction is mixed with the feedstock provided to the hydrocracking step (A2) and hydrotreated again.

(7) A production method for a diesel fuel or a diesel fuel base stock according to the items (5) or (6), wherein with respect to the hydrocracking step (A2), a single-pass decomposition yield of the recycled heavy oil (b2) is 75 to 90 volume %.

(8) A production method for a diesel fuel or a diesel fuel base stock according to one of the items (1) to (7), wherein with respect to the middle distillate (b1), the proportion of branched paraffins with 14 to 16 carbon atoms accounts for 75 mass % or more of the hydrocarbons with 14 to 16 carbon atoms.

(9) A production method for a diesel fuel or a diesel fuel base stock according to one of the items (1) to (8), wherein with respect to the middle distillate (b1), the proportion of hydrocarbons with 9 carbon atoms is 5 to 30 mass percent, the proportion of hydrocarbons with 16 carbon atoms is 0.5 to 10 mass percent, and the proportion of branched paraffins with 9 carbon atoms accounts for 45 to 75 mass % of the hydrocarbons with 9 carbon atoms.

(10) A production method for a diesel fuel or a diesel fuel base stock according to one of the items (1) to (9), wherein with respect to the middle distillate (b1), the proportion of hydrocarbons with 17 carbon atoms is 10 mass % or less.

Furthermore, the diesel fuel or the diesel fuel base stock of the present invention is as follows.

(11) A diesel fuel or a diesel fuel base stock produced by the method according to one of the items (1) to (10).

Effects of the Invention

According to the present invention, a FT synthesis oil-derived diesel fuel or diesel fuel base stock having a pour point and a kinematic viscosity suitable for utilization under very low temperature environments, and a production method thereof, can be provided. More specifically, a diesel fuel or a diesel fuel base stock with a pour point of −45° C. or lower, and a kinematic viscosity at 30° C. of 1.3 $mm^2/s$ or more, and a production method thereof, can be provided. An exceptional effect can be achieved in which, even if a pour point lowering agent is not combined for example, a diesel fuel or a diesel fuel base stock for very cold areas that is compatible with tough standards such as the Russia-A standard (GOST 305-82), in which the pour point is −55° C. or lower and the kinematic viscosity at 20° C. is 1.5 $mm^2/s$, and a production method thereof, can be provided.

BRIEF DESCRIPTION OF THE DRAWINGS

The FIGURE is a schematic diagram of a plant utilized in the production method for a diesel fuel or a diesel fuel base stock according to the present invention.

BEST MODE FOR CARRYING OUT THE INVENTION

Hereunder, an embodiment of the present invention is described in detail.

First, a preferred embodiment of a plant utilized in the production method for a diesel fuel or a diesel fuel base stock of the present invention is described with reference to the FIGURE.

A production plant 100 of a diesel fuel or a diesel fuel base stock shown in the FIGURE is primarily provided with a first fractionator 10 that fractionally distills a FT synthesis oil, a hydroisomerizer 40 and a hydrocracker 50, which are devices that respectively process the FT synthesis middle distillate (F1) and the wax fraction (F2), which are fractionally distilled in the first fractionator 10, and further, a second fractionator 20.

The respective processed products that have exited the hydroisomerizer 40 and the hydrocracker 50 are mixed and made the hydrotreated oil (a), and introduced into the second fractionator 20, in which the fractionation step B according to the present invention is performed. In the second fractionator 20, the middle distillate (b1) is drawn out from the line 22 into a diesel fuel tank 90, and stored as a diesel fuel or a diesel fuel base stock. In the FIGURE, the middle distillate (b1) is shown as a single fraction. However, it may be fractionally distilled into a plurality of fractions, such as a kerosene fraction, a gas oil fraction, and the like.

The bottom fraction (fractionator bottom fraction) of the second fractionator 20 is returned from the line 24 to the line 14 prior to the hydrocracker 50 and recycled, and is hydrocracked at the hydrocracker 50. Furthermore, the light tower top component of the second fractionator 20 is returned from the line 21 to the line 31 prior to the stabilizer 60, and introduced to the stabilizer 60.

The first fractionator 10 fractionally distills the FT synthesis oil into at least the two fractions of a FT synthesis middle distillate (F1) with a 10% distillation point of 85 to 180° C. and a 90% distillation point of 325 to 355° C., and a wax fraction (F2) containing a wax component that is heavier than the middle distillate.

That is, to the first fractionator 10 there is joined a line 1 for introducing the FT synthesis oil, a line 13 and a line 14 for transferring the respective fractions that have been fractionally distilled, and other lines. A line not shown in the drawing, the line 13, and the line 14 are respectively, in general, lines for transferring a naphtha fraction fractionally distilled under a temperature condition of less than 150° C., a middle distillate (F1) fractionally distilled under a temperature condition of 360° C. or lower, and a wax fraction (F2) fractionally distilled under a temperature condition exceeding 360° C.

The distillation characteristics, such as the 5% distillation point, the 10% distillation point, and the 90% distillation point, in the present invention are values evaluated in accordance with JIS K2254 "Petroleum Products—Determination of Distillation Characteristics".

Next, an embodiment of the production method for a diesel fuel or a diesel fuel base stock of the present invention, using the production plant 100 of such a configuration is described.

(FT Synthesis Oil)

The FT synthesis oil used in the present embodiment is not particularly limited provided it is one that is produced by the FT synthesis method. One containing 80 mass % or more based on the total amount of the FT synthesis oil, of hydrocarbons with a boiling point of 150° C. or higher, and 35 mass % or more based on the total amount of the FT synthesis oil, of hydrocarbons with a boiling point of 360° C. or higher, is preferable. The total amount of the FT synthesis oil referred to here denotes the total of the hydrocarbons with 5 or more carbon atoms produced by the FT synthesis method.

(First Fractionation Step)

In the first fractionation step, the FT synthesis oil is transferred to the first fractionator 10 through the line 1. The FT synthesis oil is fractionally distilled into at least the two fractions of a FT synthesis middle distillate (F1) with a 10% distillation point of 85 to 180° C. and a 90% distillation point of 325 to 355° C., and a wax fraction (F2) containing a wax component that is heavier than the middle distillate. As the FT synthesis middle distillate (F1), the 10% distillation point is preferably 85 to 105° C., and more preferably 90 to 100° C. The 90% distillation point is preferably 340 to 350° C. At the first fractionator 10, the FT synthesis middle distillate (F1) may be obtained by performing fractional distillation into a naphtha fraction, a kerosene-gas oil fraction, and at least one or more wax fractions containing wax components that are heavier than these, and thereafter mixing the naphtha fraction and the kerosene-gas oil fraction in an arbitrary proportion.

By making the 10% distillation point of the FT synthesis middle distillate (F1) 85° C. or higher, it is possible to prevent decreases in the yield of the diesel fuel or the diesel fuel base stock obtained in the second fractionation step (fractionation step (B)) from the light component in the hydroisomerization step (A1) mentioned below, from becoming too large. Furthermore, by making the 10% distillation point 180° C. or lower, or preferably 105° C. or lower, the low-temperature properties of the obtained diesel fuel or diesel fuel base stock can be improved.

Further, by making the 90% distillation point of the FT synthesis middle distillate (F1) 325° C. or higher, the yield of the obtained diesel fuel or diesel fuel base stock can be improved. Moreover, by making the 90% distillation point 355° C. or lower, the low-temperature properties of the obtained diesel fuel or diesel fuel base stock can be improved.

Furthermore, in terms of the wax fraction, it is preferable for the 10% distillation point to be 295 to 315° C., and the 90% distillation point to be 555 to 575° C.

In the first fractionator 10, the FT synthesis oil is fractionally distilled by setting at least one cut point. That is, the fraction below the cut point is obtained from the line 13 as the FT synthesis middle distillate (F1), and the fraction above the cut point is obtained from the line 14 as the wax fraction (F2).

Furthermore, the pressure in the first fractionator 10 can be made for reduced pressure or atmospheric pressure distillation. In general it is for atmospheric pressure distillation.

In the first fractionation step, the FT synthesis middle distillate (F1) and the wax fraction (F2) were obtained. However, just either one may be obtained. In that case, without performing the first fractionation step, the FT synthesis middle distillate (F1) or the wax fraction (F2) may be separately fractionally distilled from the FT synthesis oil, and the fractionally distilled component used as a feedstock oil to the hydrotreating step (A) mentioned below. Furthermore, without providing the first fractionation step, a FT synthesis oil obtained by condensing the gaseous portion at the reaction temperature in the FT synthesis reactor may be made the FT synthesis middle distillate (F1), and a component in which the liquid fraction at the reaction temperature in the FT synthesis reactor is drawn out, made the wax fraction (F2) that is heavier than the FT synthesis middle distillate (F1), and these may be used as feedstock oils to the hydrotreating step (A) mentioned below.

(Hydrotreating Step (A))

"Hydroisomerization Step (A1)"

The FT synthesis middle distillate (F1) is sent to the hydroisomerizer 40 by the line 13, and here, by being brought into contact with the hydroisomerization catalyst, hydroisomerization processing is performed (hydroisomerization step (A1)). That is, in the hydroisomerization step (A1), by performing hydroisomerization processing of the FT synthesis middle distillate (F1) by the hydroisomerizer 40, the hydroisomerized oil (a1) is obtained.

Since the FT synthesis middle distillate (F1) contains a considerable amount of n-paraffins, the low-temperature properties thereof, such as the low-temperature flowability, are not necessarily good. Therefore, in the present embodiment, in order to improve the low-temperature properties, hydroisomerization is performed with respect to the FT synthesis middle distillate (F1), to give the hydroisomerized oil (a1). By performing isomerization by means of hydrogenation, in addition to isomerization, the hydrogenation of olefins and dehydroxylation processing of alcohols can be performed at the same time. The FT synthesis middle distillate (F1) can contain a comparatively large amount of olefins and alcohols. Therefore, by performing such a hydroisomerization, the olefins and alcohols are converted to paraffins, and since these can be further converted to isoparaffins, the efficiency is good. It is desirable to make the alcohol content in the hydroisomerized oil (a1) preferably less than 10 mass ppm, and more preferably less than 1 mass ppm.

In terms of the hydroisomerized oil (a1) obtained in the hydroisomerization step (A1), it is preferable for the proportion of branched paraffins with 18 carbon atoms to account for 85 to 98 mass % of the hydrocarbons with 18 carbon atoms, and it is preferable for the hydrotreating conditions of the hydroisomerization step (A1) to be appropriately adjusted such that a hydroisomerized oil (a1) in this manner can be obtained. In order to further improve the low-temperature properties, it is preferable for the proportion of the branched paraffins to be 85 mass % or more, and it is more preferable for it to be 92 mass %. Furthermore, if the proportion of branched paraffins is too high, the fraction corresponding to naphtha (cracked naphtha) accompanying the progress of the cracking reaction increases, and the operation costs increase due to the yield of the middle distillate (b1) obtained in the fractionation process mentioned below decreasing, and the operation conditions becoming severe for example. Therefore, the proportion of the branched paraffins is preferably 98 mass % or less, and more preferably 96 mass % or less.

"Hydrocracking Step (A2)"

On the other hand, the wax fraction (F2) is drawn out from the line 14 of the bottom of the first fractionator 10 and transferred to the hydrocracker 50, and here, by being brought into contact with the hydrocracking catalyst, hydrocracking processing is performed (hydrocracking step (A2)). That is, in the hydrocracking step (A2), by performing hydrocracking processing of the wax fraction (F2) by the hydrocracker 50, the hydrocracked oil (a2) is obtained. Since hydrogenation is performed in the hydrocracking of the wax fraction (F2), both olefins and alcohols can be converted to paraffins. Therefore the efficiency is good. It is desirable to make the alcohol content in the hydrocracked oil (a2) preferably less than 10 mass ppm, and more preferably less than 1 mass ppm.

The hydrotreating step (A) of the present invention is configured by such a hydroisomerization step (A1) and/or a hydrocracking step (A2). Furthermore, the hydrotreated oil (a) is formed by the hydroisomerized oil (a1) and/or the hydrocracked oil (a2). The present embodiment is one in which the hydrotreated oil (a) is obtained as a result of at least a portion of the hydroisomerized oil (a1) and at least a portion of the hydrocracked oil (a2) being mixed. The mixing of the hydroisomerized oil (a) and the hydrocracked oil (a2) is not particularly limited, and it may be tank-blended or line-blended.

(Fractionation Step (B))

By introducing at least a portion of the hydrotreated oil (a), which is a mixed oil of the hydroisomerized oil (a1) and the hydrocracked oil (a2), to the second fractionator 20, which becomes a fractionator according to the present invention, and performing fractional distillation at the second fractionator 20, at the very least, a middle distillate (b1) with a 5% distillation point of 130 to 170° C. and a 95% distillation point of 240 to 300° C., and a heavy oil (b2) that is heavier than the middle distillate (b1), are obtained.

The middle distillate (b1) obtained in this manner becomes the diesel fuel or the diesel fuel base stock according to the present invention.

In the present embodiment, line blending is performed by transferring the hydroisomerized oil (a1) by the line 41, transferring the hydrocracked oil (a2) by the line 51, and merging these lines 41 and 51.

(Recycling Step (C))

At least a portion of the heavy oil (b2) is mixed with the feedstocks provided to the hydroisomerization step (A1) and/or the hydrocracking step (A2), and is hydrotreated again (recycling step (C)). That is, at least a portion of the heavy oil (b2), although not shown in the drawing, is provided together with the FT synthesis middle distillate (F1) to the hydroisomerization step (A1) by being returned to the line 13 via the line 24, and recycled to the hydroisomerizer 40 for example, and/or at least a portion of the heavy oil (b2), as shown in the FIGURE, is provided together with the wax fraction (F2) to the hydrocracking step (A2) by being returned to the line 14 via the line 24, and recycled to the hydrocracker 50.

Here, examples of the heavy oil (b2) include hydrocarbons with 15 carbon atoms and a gas oil fraction containing hydrocarbons whose carbon number is higher than 15 atoms, a fractionator bottom fraction that is heavier than the gas oil fraction, and hydrocarbons with 15 carbon atoms and a fractionator bottom fraction containing hydrocarbons whose carbon number is higher than 15 atoms. Although either aspect is acceptable, in the present invention, the heavy oil (b2) is preferably hydrocarbons with 15 carbon atoms and a fractionator bottom fraction containing hydrocarbons whose carbon number is higher than 15 atoms. Furthermore, in the recycling step (C), it is preferable for the fractionator bottom fraction to be mixed with the feedstock (wax fraction (F2)) provided to the hydrocracking step (A2) and hydrotreated again, and in the present embodiment, as shown in the FIGURE, the fractionator bottom fraction is returned to the line 14 and recycled to the hydrocracker 50.

In this manner, in terms of the heavy oil (b2), which is the heavy fraction of the hydrotreated oil (a), the heavy oil (b2) is recycled to the feedstock oil (wax fraction (F2)) of the hydrocracker 50, and is hydrocracked. Consequently, in addition to making the pour point and the kinematic viscosity of the middle distillate (b1) a quality of a diesel fuel base stock with excellent low-temperature properties, the yield of the middle distillate (b1) can be increased.

Furthermore, in the hydrocracking reaction in the hydrocracker 50, the heavy oil (b2) at the time of hydrocracking thereof, that is, preferably, the single-pass decomposition yield for example in the case of the recycling, a total feedstock oil composed of the wax fraction (F2) and the heavy oil (b2), is supplied to the hydrocracker 50. Therefore, a decomposition yield based on the fraction within the total feedstock oil containing hydrocarbons with 15 carbon atoms and higher with respect to the fraction containing hydrocarbons with 15 carbon atoms and higher is preferably made 75 to 90 volume %, and more preferably made 75 to 85 volume %. That is, in order to make the low-temperature properties and the yield of the middle distillate (b1) good, the single-pass decomposition yield is preferably made 75 volume % or more. Furthermore, since the yield of the middle distillate (b1) decreases if the single-pass decomposition yield is too high, the single-pass decomposition yield is preferably made 90 volume % or less.

(Diesel Fuel or Diesel Fuel Base Stock)

As mentioned above, in the fractionation step (B), by fractionally distilling the hydrotreated oil (a) at the second fractionator 20, a middle distillate (b1) with a 5% distillation point of 130 to 170° C., and a 95% distillation point of 240 to 300° C. is obtained, and the middle distillate (b1) is made the diesel fuel or the diesel fuel base stock according to the present invention.

The light component (tower top component) fractionally distilled at the second fractionator 20 is transferred via the line 21 and the line 31 to the stabilizer 60. Further, here, light components such as gas are drawn from the tower top thereof, and the naphtha fraction obtained from the bottom thereof is stored in the naphtha storage tank 70 via the line 61.

Furthermore, the middle distillate (b1) fractionally distilled at the second fractionator 20 is taken out (obtained) from the line 22 as the diesel fuel or the diesel fuel base stock.

Here, in order to obtain the middle distillate (b1), a plurality of fractions, such as a kerosene fraction and a gas oil fraction, may be fractionally distilled, and these fractions mixed thereafter and made the middle distillate (b1) for example. The mixing of the plurality of fractions for obtaining such a middle distillate (b1) is not particularly limited, and it may be tank-blended or line-blended.

Moreover, the pressure in the second fractionator can be made for reduced pressure or atmospheric pressure distillation. In general it is for atmospheric pressure distillation.

As shown in the recycling step (C), the fractionator bottom fraction (heavy oil (b2)) of the second fractionator 20 is recycled from the line 24 toward the line 14 that transfers the wax fraction, and is hydrocracked again at the hydrocracker 50. Therefore, at the second fractionator 20, basically, the diesel fuel or the diesel fuel base stock (middle distillate (b1)) can be obtained.

The middle distillate (b1), as mentioned above, has a 5% distillation point of 130 to 170° C., although it is preferably made 150 to 165° C. Furthermore, the 95% distillation point is 240 to 300° C., although it is preferably made 240 to 270° C., and more preferably made 245 to 255° C. In order to completely satisfy the low-temperature properties and the yield of the diesel fuel or the diesel fuel base stock, and further, the kinematic viscosity, it is necessary for the 5% distillation point to be 130 to 170° C., and the 95% distillation point to be 240 to 300° C.

Furthermore, as this middle distillate (b1), the proportion of branched paraffins with 14 to 16 carbon atoms accounts for preferably 75 mass % or more, and more preferably 80 mass % or more of the hydrocarbons with 14 to 16 carbon atoms, from the viewpoint of the low-temperature performance. Furthermore, from the viewpoint of the hydrotreating cost, it is preferably 98 mass % or less, and more preferably 94 mass % or less.

Moreover, from the viewpoint of completely satisfying the low-temperature properties and the kinematic viscosity, and further, the hydrotreating cost, the proportion of hydrocarbons with 9 carbon atoms is preferably 5 to 30 mass % and more preferably 10 to 20 mass %, the proportion of hydrocarbons with 16 carbon atoms is preferably 0.5 to 10 mass % and more preferably 2 to 10 mass %, and the proportion of branched paraffins with 9 carbon atoms accounts for preferably 45 to 75 mass %, and more preferably 50 to 65 mass %, of the hydrocarbons with 9 carbon atoms.

Furthermore, from the viewpoint of the low-temperature properties, the proportion of hydrocarbons with 17 carbon atoms is preferably 10 mass % or less, more preferably 5 mass % or less, even more preferably 3 mass % or less, particularly preferably 2 mass % or less, and preferably 0.1 mass % or less.

By making the proportions of hydrocarbons with 16 and 17 carbon atoms the ranges mentioned above, the kinematic viscosity of the obtained diesel fuel or diesel fuel base stock becomes more easily secured above a predetermined level.

As such a middle distillate (b1), by appropriately adjusting the hydrotreating conditions in the hydrotreating step (A) and/or the fractionation conditions in the fractionation step (B), one having the properties mentioned above can be obtained. Further, by appropriately adjusting the hydrotreating conditions and/or the fractionation conditions in this manner, as the middle distillate (b1), by particularly adjusting the flash point such that it becomes 30° C. or higher and 40° C. or lower (30 to 40° C.), or 30° C. or higher and less than 40° C., or preferably 30° C. or higher and 37° C. or lower (30 to 37° C.), or 30° C. or higher and less than 37° C., and the proportion of branched paraffins such that it accounts for 60 mass % or more, preferably 65 mass % or more, preferably 90 mass % or less, and more preferably 80 mass % or less of the total amount of paraffins, the diesel fuel or the diesel fuel base stock according to the present invention is obtained.

Such a middle distillate (b1) is drawn out from the second fractionator 20 as the diesel fuel or the diesel fuel base stock, transferred by the line 22 to the diesel fuel tank 90, stored, and prepared for utilization thereof. Furthermore, in a case where it is fractionally distilled into a plurality of middle distillates at the second fractionator 20, these fractions are appropriately mixed such that the distillation characteristics mentioned above are satisfied, and after being made the diesel fuel or the diesel fuel base stock, it is stored in the diesel fuel tank 90, and prepared for utilization thereof.

Here, as the diesel fuel or the diesel fuel base stock, in a case where it is utilized in cold areas in which the temperature is very low, that is, very low temperature environments, for reasons such as oil film break down at the time of operation, it is necessary that the kinematic viscosity at 30° C. be a certain value or higher. Specifically, it is preferable for the kinematic viscosity at 30° C. to be 1.3 $mm^2/s$ or more, and the kinematic viscosity at 20° C. to be 1.5 $mm^2/s$ or more, and from the viewpoint of having excellent flowability at low temperatures, it is preferable for the kinematic viscosity at 30° C. to be 2.5 $mm^2/s$ or less, and more preferable for it to be 2.0 $mm^2/s$ or less. Furthermore, since it is for utilization in cold areas in which the temperature is very low, low-temperature properties, such as a low pour point, are also necessary. Specifically, the pour point is preferably −45° C. or lower, more preferably −50° C. or lower, and even more preferably −55° C. or lower.

According to the present embodiment, a diesel fuel or a diesel fuel base stock with a kinematic viscosity at 30° C. of 1.3 $mm^2/s$ or more, and a pour point of −45° C. or lower, can be produced. In addition to the diesel fuel or the diesel fuel base stock obtained in this manner being usable as a diesel fuel product as is, it is usable as a diesel fuel base stock for obtaining diesel fuel products by mixing other FT synthesis diesel fuel base stocks, petroleum-type diesel fuel base stocks, and biodiesel fuel base stocks, or an additive.

The kinematic viscosity at 30° C. referred to here is a value measured in accordance with JIS K2283 "Crude Oil and Petroleum Products—Kinematic Viscosity Testing Method and Viscosity Index Calculation Method", and the pour point is a value measured in accordance with JIS K2269 "Testing Method of Pour Point of Crude Oil and Petroleum Products, and Cloud Point of Petroleum Products".

Next, the operation conditions, and the like, of the respective reactors for producing the diesel fuel or the diesel fuel base stock are described in more detail.

(Hydroisomerzation Step A1)

In the hydroisomerizer 40, the FT synthesis middle distillate F1 fractionally distilled in the first fractionator 10 is hydroisomerized. A known fixed-bed reactor may be used as the hydroisomerizer 40. In the present embodiment, in the reactor, a predetermined hydroisomerization catalyst is filled into the fixed bed flow-type reactor, and the FT synthesis middle distillate (F1) obtained in the first fractionator 10 is hydroisomerized. The hydroisomerization process referred to here includes, in addition to the isomerization of n-paraffins to isoparaffins, the conversion of olefins to paraffins by means of hydrogenation, and the conversion of alcohols to paraffins by means of dehydroxylation.

Examples of the hydroisomerization catalyst include a carrier configured by containing a solid acid, onto which a metal belonging to group VIII in the periodic table is loaded as an active metal.

Preferable examples of the carrier include those configured by containing one or more types of solid acids selected from within amorphous metal oxides having heat resistance, such as silica alumina, silica zirconia, and alumina boria.

Following shaping of a mixture containing the solid acid and a binder, the catalyst carrier can be produced by means of calcination. The blending ratio of the solid acid is, based on the total amount of the carrier, preferably 1 to 70 mass %, and more preferably 2 to 60 mass %.

The binder is not particularly limited, although it is preferably alumina, silica, silica alumina, titania or magnesia, and more preferably alumina. The blending quantity of the binder is, based on the total amount of the carrier, preferably 30 to 99 mass %, and more preferably 40 to 98 mass %.

The calcination temperature of the mixture is preferably within a range of 400 to 550° C., and more preferably within a range of 470 to 530° C., and even more preferably within a range of 490 to 530° C.

Examples of the group VIII metal specifically include cobalt, nickel, rhodium, palladium, iridium, and platinum. Among these, metals selected from within nickel, palladium, and platinum are preferably used singularly as one type or by combining two or more types.

These metals can be loaded on the carrier mentioned above by a common procedure, such as impregnation or ion exchange. The amount of loaded metal is not particularly limited. However, the total amount of metal with respect to the carrier is preferably 0.1 to 3.0 mass %.

The hydroisomerization reaction conditions of the first middle distillate are not particularly limited provided that a hydroisomerized oil in which the enantiomeric excess of hydrocarbons with 18 carbon atoms is 92 to 98%. It can be performed by appropriately selecting from the following reaction conditions for example.

The hydrogen partial pressure can be 0.5 to 12 MPa. However, it is preferably 1.0 to 5.0 MPa. The liquid hourly space velocity (LHSV) of the middle distillate can be 0.1 to 10.0 $h^{-1}$. However, it is preferably 0.3 to 3.5 $h^{-1}$. The hydrogen/oil ratio is not particularly limited, although it can be 50 to 1000 NL/L, and it is preferably 70 to 800 NL/L.

In the present specification, the "LHSV (liquid hourly space velocity)" refers to the volume flow of the feedstock oil per volume of the catalyst layer, in which the catalyst is filled, under standard conditions (25° C., 101325 Pa), and the unit "$h^{-1}$" indicates the inverse of time (hour). Furthermore, "NL", which represents the unit of the hydrogen volume with respect to the hydrogen/oil ratio, indicates the hydrogen volume (L) under normal conditions (0° C., 101325 Pa).

Moreover, the reaction temperature of hydroisomerization is made such that a hydroisomerized oil (a1) in which the proportion of paraffins with 18 carbon atoms accounts for 85 to 98 mass % of hydrocarbons with 18 carbon atoms can be obtained. Although it can be 200 to 370° C. for example, in order to improve the low-temperature properties, 320 to 350° C. is more preferable. If the reaction temperature exceeds 370° C., side reactions that decompose to light components increase, and not only does the yield of the middle distillate (b1) in the fractionation step (B) decrease, but the product becomes colored, and since its utilization as a fuel base stock becomes limited, it is not preferable. Furthermore, if the reaction temperature falls below 200° C., the alcohol component is not completely removed and is retained, and it is not preferable.

(Hydrocracking Step A2)

In the hydrocracker 50, the wax fraction (F2) obtained from the first fractionator 10 is hydrotreated and hydrocracked. The hydrocracker 50 may use a known fixed bed reactor. In the present embodiment, in the reactor, a predetermined hydrocracking catalyst is filled into the fixed bed flow-type reactor, and the wax fraction (F2) obtained by fractional distillation in the first fractionator 10 is hydrocracked. Furthermore, the heavy oil (b2) (fractionator bottom fraction) drawn out from the bottom of the second fractionator 20 is returned from the line 24 to the line 14, and is hydrocracked in the hydrocracker 50 together with the wax fraction (F2) from the first fractionator 10.

Although chemical reactions that accompany a decrease in the molecular weight proceed in the hydrotreating of the wax fraction (F2), this hydrotreating also includes hydroisomerization.

Examples of the hydrocracking catalyst include a carrier configured by containing a solid acid, onto which a metal belonging to group VIII in the periodic table is loaded as an active metal.

Preferable examples of the carrier include those configured by containing one or more types of solid acids selected from within crystalline zeolites, such as ultra-stable Y type (USY) zeolite, HY zeolite, mordenite or β-zeolite, and amorphous metal oxides having heat resistance, such as silica alumina, silica zirconia, and alumina boria. Further, the carrier is preferably one configured by containing one or more types of solid acids selected from within USY zeolite, silica alumina, alumina boria, and silica zirconia, and is more preferably one configured by containing USY zeolite and silica alumina.

USY zeolite is a Y-type zeolite that is ultra-stabilized by means of hydrothermal treatment and/or acid treatment, and in addition to the microporous structure of 20 Å or less originally included in Y-type zeolite, which is referred to as micropores, new fine pores in a range of 20 to 100 Å are formed. In a case where USY zeolite is utilized as a carrier of the hydrorefining catalyst, the average particle size is not particularly limited. However, it is preferably 1.0 μm or less, and more preferably 0.5 μm or less. Furthermore, in USY zeolite, the silica/alumina mole ratio (ratio of silica with respect to alumina; hereunder referred to as "silica/alumina ratio") is preferably 10 to 200, more preferably 15 to 100, and even more preferably 20 to 60.

Moreover, the carrier is preferably one configured by containing 0.1 mass % to 80 mass % of a crystalline zeolite and 0.1 mass % to 60 mass % of an amorphous metal oxide having heat resistance.

Following shaping of a mixture containing the solid acid and a binder, the catalyst carrier can be produced by means of calcination. The blending ratio of the solid acid is, based on the total amount of the carrier, preferably 1 to 70 mass %, and more preferably 2 to 60 mass %. Furthermore, in a case where the carrier is configured by containing USY zeolite, the blending quantity of USY zeolite is, based on the total amount of the carrier, preferably 0.1 to 10 mass %, and more preferably 0.5 to 5 mass %. Further, in a case where the carrier is configured by containing USY zeolite and alumina boria, the USY zeolite and alumina boria blending ratio (USY zeolite/alumina boria) is preferably 0.03 to 1 as a mass ratio. Moreover, in a case where the carrier is configured by containing USY zeolite and silica alumina, the USY zeolite and silica alumina blending ratio (USY zeolite/silica alumina) is preferably 0.03 to 1 as a mass ratio.

The binder is not particularly limited, although it is preferably alumina, silica, silica alumina, titania or magnesia, and more preferably alumina. The blending quantity of the binder is, based on the total amount of the carrier, preferably 20 to 98 mass %, and more preferably 30 to 96 mass %.

The calcination temperature of the mixture is preferably within a range of 400 to 550° C., and more preferably within a range of 470 to 530° C., and even more preferably within a range of 490 to 530° C.

Examples of the group VIII metal specifically include cobalt, nickel, rhodium, palladium, iridium, and platinum. Among these, metals selected from within nickel, palladium, and platinum are preferably used singularly as one type or by combining two or more types.

These metals can be loaded on the carrier mentioned above by a common procedure, such as impregnation or ion exchange. The amount of loaded metal is not particularly limited, although the total amount of metal with respect to the carrier is preferably 0.1 to 3.0 mass %.

The hydrocracking of the wax fraction may be performed under the following reaction conditions. That is, the hydrogen partial pressure can be 0.5 to 12 MPa, although it is preferably 1.0 to 5.0 MPa. The liquid hourly space velocity (LHSV) of the wax fraction can be 0.1 to 10.0 $h^{-1}$, although it is preferably 0.3 to 3.5 $h^{-1}$. The hydrogen/oil ratio is not particularly limited, although it can be 50 to 1000 NL/L, and it is preferably 70 to 800 NL/L.

Furthermore, the reaction temperature of hydrocracking can be 200 to 370° C. for example, although in order to improve the low-temperature properties and the yield of the middle distillate (b1), 300 to 320° C. is more preferable. If the reaction temperature exceeds 370° C., side reactions that decompose to light components increase, and not only does the yield of the middle distillate (b1) in the fractionation step (B) decrease, but the product becomes colored, and since its utilization as a fuel base stock becomes limited, it is not preferable. Furthermore, if the reaction temperature falls below 200° C., the alcohol component is not completely removed and is retained, and it is not preferable.

According to the production method of the present invention, a diesel fuel or a diesel fuel base stock with a pour point of −45° C. or lower, and a kinematic viscosity at 30° C. of 1.3 $mm^2/s$ or more, can be produced.

Therefore, even if a pour point lowering agent is not combined for example, a diesel fuel or a diesel fuel base stock for very cold areas that is compatible with tough standards such as the Russia-A standard (GOST 305-82), in which the pour point is −55° C. or lower and the kinematic viscosity at 20° C. is 1.5 $mm^2/s$, can be produced.

The foregoing has described a preferred embodiment of the present invention with reference to the drawing. However the detailed configurations are in no way limited to this embodiment, and design changes and the like are included within a scope that does not depart from the gist of the present invention or the elements disclosed in the claims.

For example, provided the diesel fuel or the diesel fuel base stock of the present invention can be obtained, the diesel fuel or the diesel fuel base stock of the present invention may be obtained without providing the first fractionation step, and using either the FT synthesis middle distillate (F1), which is a FT synthesis oil wherein the gaseous portion at the reaction temperature in the FT synthesis reactor is condensed and liquefied, or the wax fraction (F2), in which the liquid fraction at the reaction temperature in the FT synthesis reactor is drawn out, that is heavier than the FT synthesis middle distillate (F1), and mixtures of these, as a feedstock oil to the hydrotreating step (A) consisting of the hydroisomerization step (A1) and/or the hydrocracking step (A2). Furthermore, the diesel fuel or the diesel fuel base stock of the present invention may be obtained without providing the recycling step (C), by adjusting the hydrogenation conditions in the hydrotreating step (A) and/or the fractionation conditions in the fractionation step (B).

EXAMPLES

Hereunder, the present invention is described in more detail by means of examples. However, the present invention is in no way limited to these examples.

(Preparation of Catalyst)

(Catalyst A)

Silica alumina (silica/alumina mole ratio:14) and an alumina binder were mixed and kneaded at a weight ratio of 60:40, and following shaping of the mixture into a cylindrical shape with a diameter of approximately 1.6 mm and a length of approximately 4 mm, it was calcined at 500° C. for 1 hour, and the carrier was obtained. This carrier was impregnated with a chloroplatinic acid aqueous solution and loaded with platinum. The carrier loaded with platinum was dried at 120° C. for 3 hours, and by calcining at 500° C. for 1 hour thereafter, the catalyst A was obtained. The loaded amount of platinum was, with respect to the carrier, 0.8 mass %.

(Catalyst B)

USY zeolite (silica/alumina molar ratio:37) having an average particle size of 1.1 μm, silica alumina (silica/alumina molar ratio:14), and an alumina binder were mixed and kneaded at a weight ratio of 3:57:40, and following shaping of the mixture into a cylindrical shape with a diameter of approximately 1.6 mm and a length of approximately 4 mm, it was calcined at 500° C. for 1 hour, and the carrier was obtained. This carrier was impregnated with a chloroplatinic acid aqueous solution and loaded with platinum. The carrier loaded with platinum is was dried at 120° C. for 3 hours, and by calcining at 500° C. for 1 hour thereafter, the catalyst B was obtained. The loaded amount of platinum was, with respect to the carrier, 0.8 mass %.

Example 1

Production of Diesel Fuel or Diesel Fuel Base Stock (Fractional Distillation of FT Synthesis Oil)

As the product oil (FT synthesis oil) obtained by the FT synthesis method, a product oil having a content of hydrocarbons with a boiling point of 150° C. or higher of 84 mass %, a content of hydrocarbons with a boiling point of 360° C. or higher of 42 mass %, and a content of hydrocarbons with 20 to 25 carbon atoms of 15 mass % (each content is based on the entire amount of the FT synthesis oil (total of the hydrocarbons with 5 or more carbon atoms)), was prepared. This product oil (FT synthesis oil) was provided to the first fractionator 10 and fractionally distilled into three, namely a naphtha fraction, a middle distillate containing a kerosene fraction and a gas oil fraction, and a wax fraction that was heavier than these, and by mixing the naphtha fraction and the middle distillate, a FT synthesis middle distillate (F1) with a 10% distillation point of 90° C. and a 90% distillation point of 333° C., and a wax fraction (F2) were obtained.

As the product oil (FT synthesis oil) obtained by the FT synthesis method, a product oil having a content of hydrocarbons with a boiling point of 150° C. or higher of 84 mass %, a content of hydrocarbons with a boiling point of 360° C. or higher of 42 mass %, and a content of hydrocarbons with 20 to 25 carbon atoms of 25.2 mass % (each content is based on the entire amount of the FT synthesis oil (total of the hydrocarbons with 5 or more carbon atoms)), was prepared. This product oil (FT synthesis oil) was provided to the first fractionator 10 and fractionally distilled into a FT synthesis middle distillate (F1) with a 10% distillation point of 85 to 185° C. and a 90% distillation point of 325 to 355° C., and a wax fraction (F2).

(Hydroisomerization Step)

The catalyst A (150 ml) was filled into the hydroisomerizer 40, which was a fixed bed flow-type reactor. Further, the hydroisomerizer 40 was supplied with the FT synthesis middle distillate (F1) from the tower top thereof at a speed of 300 ml/h, and hydrotreatment was performed under a hydrogen flow.

That is, hydrogen was supplied from the tower top at a hydrogen/oil ratio of 338 NL/L with respect to the first middle distillate, and a back pressure valve was adjusted such that the hydrogen partial pressure in the reactor pressure became constant at an inlet pressure of 3.0 MPa. The hydroisomerized oil (a1) was obtained by performing the hydroisomerization reaction under such conditions. The reaction temperature at this time was 330° C.

(Hydrocracking Step)

The catalyst B (150 ml) was filled into the hydrocracker 50, which was a fixed bed flow-type reactor. Further, the hydrocracker 50 was supplied with the wax fraction from the tower top thereof at a speed of 300 ml/h, and hydrotreatment was performed under a hydrogen flow.

That is, hydrogen was supplied from the tower top at a hydrogen/oil ratio of 667 NL/L with respect to the wax component, and a back pressure valve was adjusted such that the hydrogen partial pressure in the reactor pressure became constant at an inlet pressure of 4.0 MPa.

The hydrocracked oil was obtained by performing hydrocracking under such conditions. The reaction temperature at this time was 310° C. Furthermore, the single-pass decomposition yield of the fractionator bottom fraction of 15 or more carbon atoms at the time of this hydrocracking was 80 volume %.

(Fractionation Step)

The hydroisomerized oil (a1) obtained from the FT synthesis middle distillate (F1) and the hydrocracked oil (a2) obtained from the wax fraction (F2) were line blended according to their respective yields. Further, the obtained mixed oil (hydrotreated oil (a)) was fractionally distilled in the second fractionator 20, and a middle distillate (b1) with a 5% distillation point of 156° C. and a 95% distillation point of 246° C., and a fractionator bottom fraction (b2) containing hydrocarbons with 15 carbon atoms and higher, were obtained.

(Recycling Step)

Furthermore, the heavy oil (fractionator bottom fraction containing hydrocarbons with 15 carbon atoms and higher) of the second fractionator 20 was continuously returned to the line 14 of the inlet of the hydrocracker 50 and recycled, and hydrocracked again together with the wax fraction (F2).

The single-pass decomposition yield of the bottom fraction in the hydrocracking step (A2) at this time was 80 volume %.

Moreover, the flash point of the middle distillate (b1) obtained in the second fractionator 20 at this time became 30 to 40° C., and the proportion of branched paraffins accounted for 69 mass % of the total amount of paraffins. Further, the middle distillate (b1) was drawn out, and stored in the diesel fuel tank 90 as the diesel fuel or the diesel fuel base stock.

Furthermore, the tower top component of the second fractionator was drawn out from the line 21 and introduced into the stabilizer 60.

The respective properties of the obtained diesel fuel or diesel fuel base stock are shown in Table 1. In Table 1, cases where the pour point was −45° C. or lower and the kinematic viscosity at 30° C. was 1.3 $mm^2/s$ or higher were determined as being able to produce a FT synthesis oil-derived diesel fuel base stock with very superior low-temperature properties, which is an effect of the present invention, and denoted by a "good", and other cases were denoted by a "Not good". Furthermore, within Table 1, the "proportion of branched paraffins" shows the proportion of the entire amount of paraffins accounted for by branched paraffins, the "proportion of branched paraffins with 14 to 16 carbon atoms" shows the proportion of hydrocarbons with 14 to 16 carbon atoms accounted for by branched paraffins with 14 to 16 carbon atoms, and the "proportion of branched paraffins with 9 carbon atoms" shows the proportion of hydrocarbons with 9 carbon atoms accounted for by branched paraffins with 9 carbon atoms.

The kinematic viscosity at 20° C. was 1.5 $mm^2/s$ or more.

TABLE 1

| | Example 1 | Example 2 | Comparative Example 1 |
|---|---|---|---|
| 5% distillation point (° C.) | 156 | 158 | 169 |
| 95% distillation point (° C.) | 246 | 262 | 329 |
| Pour point (° C.) | −59 | −52 | −42 |
| Kinematic viscosity at 30° C. ($mm^2/s$) | 1.35 | 1.50 | 1.87 |
| Flash point (° C.) | 33 | 34 | 37 |
| Proportion of branched paraffins (mass %) | 69 | 71 | 85 |
| Proportion of branched paraffins with 14 to 16 carbon atoms (mass %) | 86 | 87 | 86 |
| Proportion of hydrocarbons with 9 carbon atoms (mass %) | 16 | 14 | 1 |
| Proportion of branched paraffins with 9 carbon atoms (mass %) | 56 | 56 | 50 |
| Proportion of hydrocarbons with 16 carbon atoms (mass %) | 3.1 | 6.2 | 12.4 |
| Proportion of hydrocarbons with 17 carbon atoms (mass %) | 0.5 | 2.6 | 11.7 |
| Low-temperature properties | good | good | Not good |

Here, the pour point was determined in accordance with JIS K2269 "Testing Method of Pour point of Crude Oil and Petroleum Products, and Cloud Point of Petroleum Products". Furthermore, the kinematic viscosity at 30° C. was determined in accordance with JIS K2283 "Crude Oil and Petroleum Products—Kinematic Viscosity Testing Method and Viscosity Index Calculation Method". In Comparative Example 1 below, the respective values were determined by the same methods.

Example 2

Except for making the fraction of the heavy oil heavier in the recycling step of Example 1, the diesel fuel or the diesel fuel base stock was obtained in the same manner as Example 1. The properties of the obtained diesel fuel base stock are shown in Table 1. The kinematic viscosity at 20° C. was 1.5 $mm^2/s$ or more.

Comparative Example 1

Other than the heavy oil (fractionator bottom portion containing hydrocarbons with 15 carbon atoms and higher)

obtained in the fractionation process not being recycled, and the 5% distillation point of the middle distillate (b1) being made 169° C. and the 95% distillation point being made 329° C., the diesel fuel or the diesel fuel base stock was obtained in the same manner as Example 1. The properties of the obtained diesel fuel base stock are shown in Table 1.

Reference Example 1

In the methods of Examples 1 and 3 of WO2009/041478 (PCT International Publication No. 09/041487), the kerosene fractions 1 and 2 obtained therein (Table 2 of the same publication) respectively have a proportion of branched paraffins of less than 60 mass %, the flash points are 45° C. or higher, and the pour points are −42.5° C. or higher. They respectively did not contain hydrocarbons with 16 or more carbon atoms (not shown).

Reference Example 2

In the methods of Examples 1 and 3 of WO2009/041478 (PCT International Publication No. 09/041487), the gas oil fractions 1 and 2 obtained therein (Table 2 of the same publication) and their mixtures with the kerosene fractions 1 and 2 (Table 3 of the same publication) respectively have pour points of −20° C. or higher (not shown).

From the results shown in Table 1, in Example 1 and Example 2, the pour point is −45° C. or lower, and the kinematic viscosity at 30° C. is 1.3 $mm^2/s$ or more, confirming that a FT synthesis oil-derived diesel fuel or diesel fuel base stock having a pour point and a kinematic viscosity suitable for utilization under very low temperature environments can be produced.

INDUSTRIAL APPLICABILITY

The present invention is able to produce a diesel fuel with good low-temperature properties from a FT synthesis oil, and can provide a diesel fuel base stock that is usable even under very low temperature environments, in which the utilization was conventionally problematic.

BRIEF DESCRIPTION OF THE REFERENCE SYMBOLS

10 FIRST FRACTIONATOR
20 SECOND FRACTIONATOR
40 HYDROISOMERIZER
50 HYDROCRACKER
100 PRODUCTION PLANT OF DIESEL FUEL BASE STOCK

The invention claimed is:

1. A method for producing a diesel fuel or a diesel fuel base stock, comprising:

a hydrotreating step (A) comprising (i) a hydroisomerization step (A1) of contacting a hydroisomerization feedstock comprising a Fischer-Tropsch (FT) synthesis oil, which contains a middle distillate and/or a wax fraction that is heavier than the middle distillate, with a hydroisomerization catalyst at a temperature of 320 to 350° C. to produce a hydroisomerized oil (a1), and (ii) a hydrocracking step (A2) of contacting a hydrocracking feedstock comprising the wax fraction with a hydrocracking catalyst at a temperature of 300 to 320° C. to produce a hydrocracked oil (a2); and a fractionation step (B) comprising (i) transferring at least a portion of a hydrotreated oil (a) comprising the hydroisomerized oil (a1) and the hydrocracked oil (a2) to a fractionator and, (ii) obtaining a middle distillate (b1) with a 5% distillation point of 130 to 170° C. and a 95% distillation point of 240 to 300° C. and a heavy oil (b2), wherein with respect to the hydroisomerized oil (a1), a proportion of branched paraffins with 18 carbon atoms accounts for 85 to 98 mass % of the hydrocarbons with 18 carbon atoms, wherein the middle distillate (b1) has a flash point of 30 to 40° C. a pour point of −45° C. or lower, a kinematic viscosity at 30° C. of 1.3 $mm^2/s$ or more, and a proportion of branched paraffins of 60 mass % or more with respect to the total amount of paraffins, and wherein the middle distillate (b1) is used as a diesel fuel or a diesel fuel base stock.

2. The method according to claim 1, wherein the hydrotreated oil (a) is a mixture of a portion of the hydroisomerized oil (a1) and a portion of the hydrocracked oil (a2).

3. The method according to claim 1, wherein the hydroisomerization feedstock is a FT synthesis middle distillate (F1) with a 10% distillation point of 85 to 180° C. and a 90% distillation point of 325 to 355° C. and the hydrocracking feedstock is a wax fraction (F2) that is heavier than the FT synthesis middle distillate (F1).

4. The method according to claim 1, further comprising a recycling step (C) in which at least a portion of the heavy oil (b2) is mixed with the hydroisomerization feedstock and/or the hydrocracking feedstock to produce a recycled heavy oil.

5. The method according to claim 4, wherein with respect to the recycling step (C), the at least a portion of the heavy oil (b2) is a fractionator bottom fraction containing hydrocarbons with 15 carbon atoms and higher, and the fractionator bottom fraction is mixed with the hydrocracking feedstock.

6. The method according to claim 4, wherein with respect to the hydrocracking step (A2), a single-pass decomposition yield of the recycled heavy oil is 75 to 90 volume %.

7. The method according to claim 1, wherein with respect to the middle distillate (b1), a proportion of branched paraffins with 14 to 16 carbon atoms accounts for 75 mass % or more of the hydrocarbons with 14 to 16 carbon atoms.

8. The method according to claim 1, wherein with respect to the middle distillate (b1), a proportion of hydrocarbons with 9 carbon atoms is 5 to 30 mass percent of the middle distillate (b1), a proportion of hydrocarbons with 16 carbon atoms is 0.5 to 10 mass percent of the middle distillate (b1), and a proportion of branched paraffins with 9 carbon atoms accounts for 45 to 75 mass % of the hydrocarbons with 9 carbon atoms.

9. The method according to claim 1, wherein with respect to the middle distillate (b1), a proportion of hydrocarbons with 17 carbon atoms is 10 mass % or less of the middle distillate (b1).

10. A diesel fuel or a diesel fuel base stock produced by the method according to claim 1.

* * * * *